US006672216B2

(12) United States Patent
Ettmueller

(10) Patent No.: US 6,672,216 B2
(45) Date of Patent: Jan. 6, 2004

(54) SECURING AND ARMING DEVICE AND USE THEREOF

(75) Inventor: Peter Ettmueller, Bachenbülach (CH)

(73) Assignee: Oerlikon Contraves Pyrotec AG, Zurich (CH)

( * ) Notice: Subject to any disclaimer, the term of this patent is extended or adjusted under 35 U.S.C. 154(b) by 0 days.

(21) Appl. No.: 10/177,787

(22) Filed: Jun. 20, 2002

(65) Prior Publication Data

US 2003/0010244 A1 Jan. 16, 2003

(30) Foreign Application Priority Data

Jul. 16, 2001 (CH) ..... 2001 1314/01

(51) Int. Cl.[7] ..... F42C 15/26
(52) U.S. Cl. ..... 102/255
(58) Field of Search ..... 102/255

(56) References Cited

U.S. PATENT DOCUMENTS 3,320,891 A * 5/1967 Holmes ..... 102/245
3,435,766 A * 4/1969 St. John ..... 102/255
3,703,866 A * 11/1972 Semenza ..... 102/238
4,215,635 A * 8/1980 Farace ..... 102/238
4,262,598 A * 4/1981 Burg et al. ..... 102/246
4,796,532 A * 1/1989 Webb ..... 102/233
4,942,816 A * 7/1990 Bankel et al. ..... 102/235
5,056,434 A * 10/1991 Patel et al. ..... 102/238
5,216,196 A * 6/1993 Anderson ..... 102/235
6,029,385 A 2/2000 Howell, Jr.

* cited by examiner

*Primary Examiner*—Michael J. Carone
*Assistant Examiner*—Bret Hayes
(74) *Attorney, Agent, or Firm*—McCormick, Paulding & Huber LLP

(57) ABSTRACT

A securing and arming device has an operating body. Prior to an arming time, this operating body is secured in a position of rest on a support device, namely by means of a securing element, which here is in a securing position. If the securing element is moved into a release position, it releases the operating body to make a movement in relation to the support device. After the arming time, the trigger body is in an operating position by means of a rotating movement in relation to the support device. A delay element is designed to be driven in the course of the rotating movement of the trigger body and to delay the rotating movement of the trigger body. The trigger body and the delay element are arranged inside each other so that they constitute an outer wheel shaft-free wheel and an inner wheel shaft-free wheel. The two wheels have parallel geometric wheel axes and define a ring-like gap. At least one of the wheels has a wavy circumferential surface facing the other one of the wheels with wave crests and wave troughs. The wheels rest with areas of their surfaces facing each other on motion transfer bodies, which are located in the ring-like gap and are seated therein in a radially displaceable manner.

18 Claims, 2 Drawing Sheets

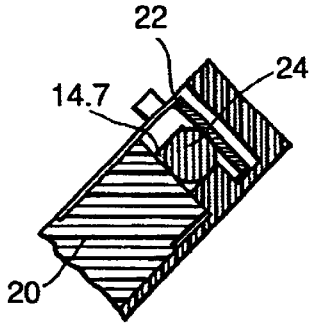
Fig. 3
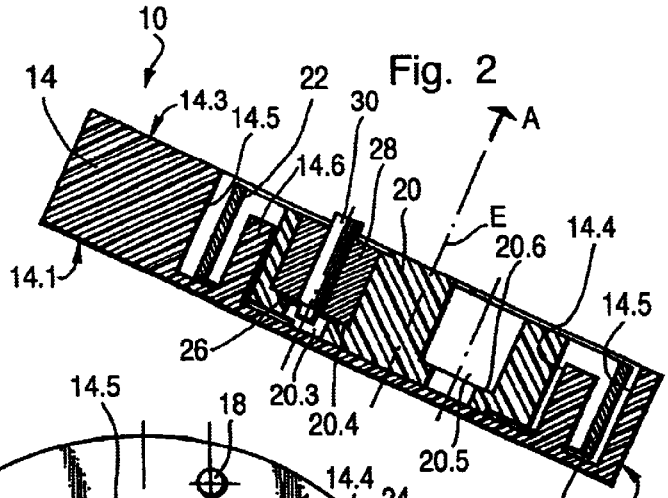
Fig. 2
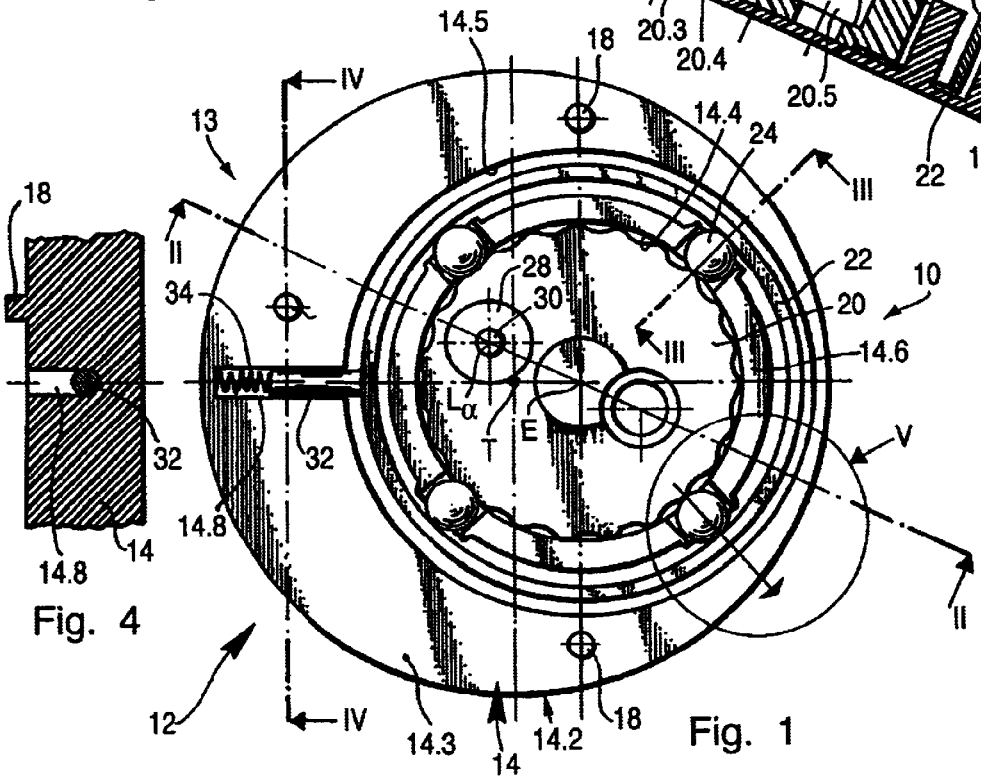
Fig. 4
Fig. 1
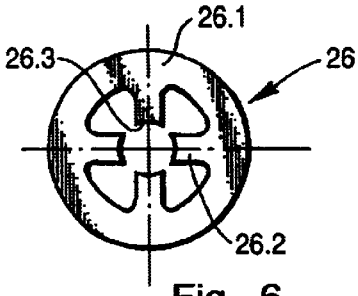
Fig. 6

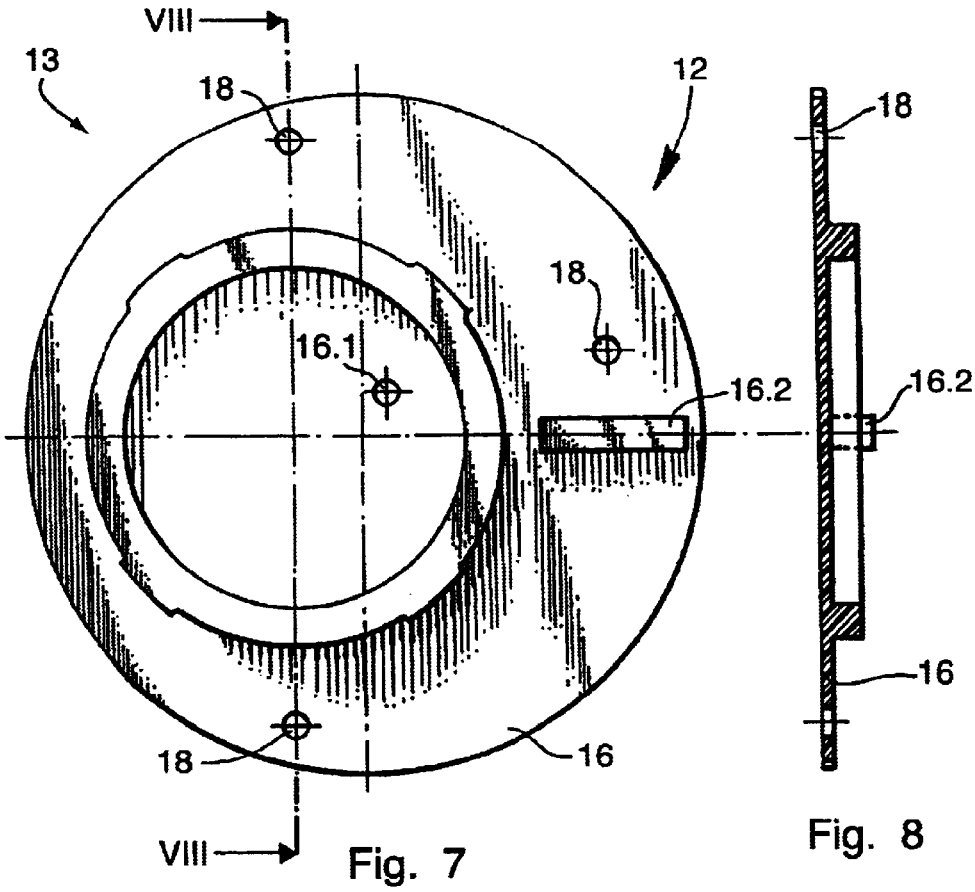
Fig. 7
Fig. 8
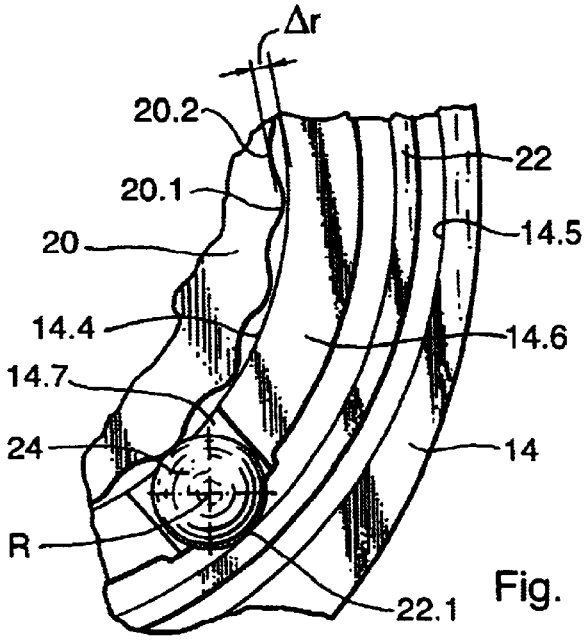
Fig. 5

SECURING AND ARMING DEVICE AND USE THEREOF

CROSS REFERENCE TO RELATED APPLICATION

This application claims priority from and incorporates by reference the subject matter of Swiss Patent Application No. 2001 1314/01 filed on Jul. 16, 2001.

FIELD OF THE INVENTION

The invention relates to a securing and arming device having an operating body and a delay element. The invention further relates to the use of such a securing and arming device in connection with a spin-stabilized projectile.

BACKGROUND OF THE INVENTION

Securing and arming devices of this kind are used to inhibit a function of a mechanism during a mounted or rest state, or prior to a ready or arming time, and in this way to secure the mechanism in its mounted or rest state, and to make possible the function, which had been inhibited up to that time, after the ready or arming time has been reached; this does not mean that the said function takes place immediately before the arming time, but only that, starting at this arming time, this function can be triggered if appropriate triggering measures are being taken. The device therefore is in a standby status after the arming time. Securing and arming devices of this type can be employed, inter alia, in projectiles with mechanical and electronic fuses for inhibiting the fuse function, or the disaggregation of the projectiles up to a defined time. Although the identification of the device as a securing and arming device comes from projectile technology, within the scope of the invention it should not be understood to mean that the device can only be utilized in projectile technology. Devices of this type can moreover be used as securing and arming devices; when reaching the moment which had been called arming time above, the function which was inhibited up to that time becomes active; in this case this is not only made possible, but no further steps need to be taken for the actual performance of this function.

conventional securing and arming devices are basically designed in the form of clockwork mechanisms. They comprise a multitude of structural elements, inter alia rotating parts, in particular gear wheels, a balance wheel, as well as a spring mechanism, if required. The rotating parts are centrally guided, i.e. through their shafts, and some are also driven. Often many structural elements are embodied as stamped parts.

Such securing and arming devices in the form of clockwork mechanisms have many disadvantages, the most serious of which will be briefly described in what follows. Clockwork mechanisms are elaborate as a result of the multitude of the components from which they are constructed, expensive to produce and to assemble. Many components are stamped parts, which often contain inaccuracies and as a result of the stamping process have interfering burs, whose complete removal is time-consuming and difficult, if not impossible. Anyway, precise functioning is only assured if the shafts which guide the rotating parts are exactly lined up with each other, which again increases the production and assembly outlay.

OBJECT AND SUMMARY OF THE INVENTION

The object of the invention is therefore seen to be the creation of a securing and arming device of the type mentioned at the outset, by means of which the above described disadvantages of the prior art are avoided, and the proposal of a preferred utilization of such a securing and arming device.

This object is attained in accordance with the invention in connection with the securing and arming device having an operating body and a delay element arrayed one inside the other with a ring-like gap and a motion transfer body between the operating body and the element. The object of the invention also includes a spin-stabilized projectile in which the securing and arming device is utilized.

Preferred further developments of the securing and arming device in accordance with the invention are described below.

The securing and arming device in accordance with the invention, only called the device for short in what follows, has an operating body which, by a rotary movement, is moved out of its mounted position into an operating position, which can also be called the standby position. In the mounted position the operating body is secured, or blocked, by means of a securing device, or by at least one securing element. To this end, the securing device is in its securing position. As soon as the securing device is moved out of its securing position into a release position, it releases the operating body and the latter moves out of its mounted position into its operating position. To delay the rotary movement performed in the course of this, i.e. to extend the time interval between leaving the mounted position and reaching the operating position, a delay element is provided, which is put into motion simultaneously with the operating body. The delay element and the operating body are designed as cylindrical, or hollow-cylindrical elements, or wheels with parallel axes, wherein the one wheel axis can be displaced in relation to the other wheel axis parallel with the axis direction. The wheels are designed as an outer wheel and an inner wheel, wherein the inner wheel is arranged inside the outer wheel. Because of this, a gap similar to an arc of a circle is created between facing surfaces of the wheels, which has a gap width which changes positionally and chronologically, which will be explained further down below. As mentioned, the wheels have surfaces which are located facing each other and are essentially cylindrical; but at least one of these surfaces is provided with waves, i.e. it is embodied to be wavy, wherein wave crests and wave troughs extend at least approximately in the direction of the wheel axes. Motion transfer bodies are arranged between the facing surfaces of the wheels, which are in contact with these surfaces and which can be displaced radially, or transversely in respect to the wheel axes. When the wheel which is embodied to be wavy performs a rotary movement, its wave crests and wave troughs move past the motion transfer bodies. The result of this is that the motion transfer bodies are alternately displaced back and forth in a radial direction, so that the other wheel is inevitably caused to perform a tumbling movement. This tumbling movement causes the desired delay effect. The wheels only have geometric axes of rotation, but no physical wheel shafts on which they are arranged; the drive is performed via the circumference; i.e. the wheels are free of wheel shafts.

The following advantages in particular are achieved by means of a device embodied in this way:

The device is designed in such a way that it has no rotating elements which are guided and driven by shafts, i.e. centrally. All components which perform rotating movements are without shafts, i.e. they are guided peripherally, namely at their circumference. Optimal precision with greatly reduced production and assembly outlay is achieved by means of this.

The number of components employed is considerably reduced;

production and assembly are simplified by this.

Practically only molded or extruded plastic parts are used in place of stamped metal parts, so that the problem of production-related burs is prevented.

In preferred exemplary embodiments of the device of the invention, the inner wheel constitutes the operating body and the outer wheel the delay element, and it is preferably the operating body which is embodied to be wavy on its surface which lies facing the delay element.

The operating body has an unbalanced mass, or an eccentrically arranged inertia mass, and is arranged on a support device. The support device rotates around a support device axis which is oriented at least approximately parallel in relation to the axis of rotation of the operating body; it is pointed out that this axis of rotation is merely a geometric, or one-dimensional axis, and not a three-dimensional physical drive or guide shaft. This axis of rotation of the operating body, which is also called a blocking axis or eccentric axis, is arranged eccentrically in relation to the support device axis. In its mounted position the operating body is secured on the support device by the securing device. In the course of this it moves together with the support device, but not relative to the support device. When the securing device gets into its release position, the operating body is released and now can move relative to the support device, or perform a rotary movement around the blocking axis. In the course of this the operating body—under the influence of the inertia or centrifugal force acting on it—tries to move into an end position, in which its inertial mass is at the greatest possible distance from the axis of rotation of the support device. This end position corresponds to the operating position, or the standby position.

The displacement of the securing device out of its securing position into its release position preferably also takes place by means of the effect of an inertial force, which acts on the securing device in the radial and/or axial direction during a movement of the support device.

In most cases it has been shown to be advantageous to use a securing device with two separate securing elements; in some applications the arrangement of two securing elements is even prescribed by safety regulations. It is advantageous here to embody a first securing element in the form of a transverse securing bolt, which is arranged in the support device and is pressed into its securing position by the force of a radially oriented spring, i.e. against one of the wheels, preferably the triggering body which is arranged as the outer wheel. By means of this the wheel is secured at the support device, or is blocked, when the support device does not rotate or rotates only slowly. With an increasing speed of rotation of the support device, starting at a defined time, the centrifugal force acting on the transverse securing bolt overcomes the force of the spring. The result of this is that under the influence of the centrifugal force the transverse securing bolt is moved outward into its release position and in the process releases the wheel it had previously acted upon. A second securing element, which is embodied as a linear securing bolt, is provided in addition to the just described first securing element.

In its securing position, the linear securing bolt secures one of the wheels, preferably the operating body, on the support device, as long as the latter is not subjected to any, or not a large linear acceleration in the direction of the support device axis. Then, if the support device is subjected to a linear acceleration of sufficient strength, the linear securing bolt is displaced by the effects of inertia forces into its release position, in which it no longer secures the blocking body on the support device. In principle, each one of the just described securing elements can be employed by itself, i.e. as the sole securing element.

The linear securing bolt is preferably arranged in a recess of the operating body and, in its securing position, one end of it projecting from the operating body engages a complementary recess of the support device. The other end of the linear securing bolt is prevented from sliding out of the recess by means of a retaining element. During a linear, or axial acceleration of the support device, the linear securing bolt, because of the inertial force acting on it, exerts a deforming effect on the retaining element in such a way that the deformed retaining element no longer prevents the linear securing bolt from being displaced.

The retaining element preferably is embodied in such a way that in its deformed configuration it prevents a retrograde movement of the linear securing bolt, by means of which it would be returned into its original position relative to the other components of the device.

To obtain a space-saving arrangement, the placement of the linear securing bolt is advantageously selected in such a way that the total dimension of the device following the displacement of the linear securing bolt is not greater than prior to this displacement.

The linear securing bolt can be received in a hollow body, preferably a hollow cylinder, which in turn is located in the recess of the operating body; in this case the hollow cylinder can constitute the inertial mass, so that a particularly simple device is obtained.

The motion transfer bodies which are contacted by both wheels, i.e. the operating body as well as the delay element, are generally arranged on, or in the support device in such a way that they can be displaced relative to the support device only in the direction of their connection line with the center of the one wheel, preferably the operating body, but are secured against displacement in the direction of the support device axis and in the circumferential direction. But a certain amount of play in the axial direction can be advantageous.

The motion transfer bodies are preferably embodied as rotational solids. Spheres, barrel-like rotational solids, cylinders or truncated cones are advantageous, whose axes are directed parallel, or nearly parallel, in relation to the axes of the wheels, or cylinders and other prismatic bodies, whose axis are radially oriented in relation to the wheels. The dimensions of the motion transfer bodies are selected to match the configuration of the wave crests and wave troughs.

It has been shown to be advantageous to produce the support device in the form of a housing consisting of a base plate and a cover plate.

It is obvious that the time interval for the rotary movement of the operating body is determined by the dimensions and masses of the various moving components of the device, as well by as their surface or frictional properties, and possibly by the linear acceleration of the support device.

As has been mentioned above, the device in accordance with the invention is preferably employed as a securing and arming device for spin-stabilized projectiles. When used in this way, the support device, or the housing having the support device, is fixedly connected with the casing of the projectile, the speed of rotation corresponds to the velocity of the spin and the linear acceleration corresponds to the forward acceleration of the projectile, which the latter undergoes upon being fired.

Further details and advantages of the invention will be extensively described in what follows by means of an exemplary embodiment of the device of the invention and with reference to the drawings.

BRIEF DESCRIPTION OF THE DRAWINGS

FIG. 1 is a view from above on a device of the invention, but without the cover plate of the support device constituting the housing, FIG. 2 shows the device represented in FIG. 1, also without the cover plate of the housing, in a sectional view along II—II in FIG. 1, FIG. 3 shows portions of the device represented in FIGS. 1 and 2, also without the cover plate of the housing, in a sectional view along III—III in FIG. 1, FIG. 4 shows the device represented in FIGS. 1 and 3, also without the cover plate of the housing, in a sectional view along IV—IV in FIG. 1, FIG. 5 shows a detail of FIG. 1 in an enlarged scale, FIG. 6 is a view from above on a spring washer represented in FIG. 2 in an enlarged scale, FIG. 7 is a plan view from below of the cover plate of the device in accordance with the invention, and FIG. 8 shows the cover plate represented in FIG. 7 in a sectional view along VIII—VIII in FIG. 7.

DETAILED DESCRIPTION OF THE PREFERRED EMBODIMENTS

To start, it should be mentioned that in the following description statements such as "top", "bottom", "right", "left" refer to the arrangement of the components in the represented positions.

In accordance with FIG. 1 and FIG. 2, the device 10 comprises a support device 12 which, in the present exemplary embodiment, is constituted by a housing 13. The housing 13 comprises a base plate 14 and a cover plate 16, which are fastened to each other by suitable means 18. Suitable means are, for example, screw connections, adhesive connections, welded connections or frictional and/or interlocking connections, which are provided by appropriately deformed areas of the housing. The housing 13 has an exterior shape of a very low cylinder, wherein the cylinder axis is denoted as support device axis T.

On the bottom, the base plate 14 of the housing 13 is bordered by a flat base plate bottom 14.1, and laterally by a cylindrical exterior base plate surface 14.2. It has a cylindrical recess 14.4, which extends from its upper surface 14.3 and is arranged eccentrically in relation to the base plate 14. An operating body 20, called a wave wheel 20 in what follows, and whose details will be described further down below, is received in the cylindrical recess 14.4. The base plate 14 moreover has a recess 14.5 in the form of a cylinder envelope, which also extends from its upper surface 14.3 and in which a delay element 22, or tumbling ring 22, is received as the outer wheel; the meaning of the term tumbling ring will become clear in the further course of the description.

For their guidance and drive, the wave wheel 20, the tumbling ring 22 and the motion transfer bodies 24 do not have physical, i.e. three-dimensional shafts, their guidance, or drive is provided by guidance of their circumference. In spite of this they have geometric one-dimensional axes of rotation around which they turn in the course of the rotating movement.

The cylindrical recess 14.4 and the recess 14.5 in the form of a cylinder envelope have a common trigger axis E, which extends parallel in relation to the support device axis T, is arranged eccentrically in the housing 13 and is spaced apart from the support device axis T.

A base plate ring 14.6 in the form of a cylinder envelope is formed on the base plate 14 of the housing 13 between the cylindrical recess 14.4 and the recess 14.5 in the form of a cylinder envelope. This base plate ring 14.6 is of a lesser height in the axial direction than the base plate 14 and therefore does not extend to the height of the upper base plate surface 14.3. The base plate ring 14.6 has depressions 14.7 at each of four locations, which are respectively displaced by 90° in relation to each other. In accordance with FIGS. 3 and 5, a motion transfer body 24 in the shape of a sphere with a center R is arranged in each one of the depressions 14.7. The tumbling ring 22 touches the areas of the motion transfer bodies 24 which are facing away from the trigger axis E with four areas of its inner surface 22.1.

A different number of motion transfer bodies can be provided in other embodiments of the device of the invention, and the motion transfer bodies can be embodied to be cylindrical or conical, for example.

The wave wheel 20 has a wavy circumferential surface, wherein wave crests 20.1, or protrusions, and wave troughs 20.2, or grooves, located between them extend parallel with the support device axis T and with the trigger axis E. The wavy embodiment can also be limited to that axial area of the wave wheel 20 in which a contact with the motion transfer bodies 24 takes place. The wave crests 20.1 and the wave troughs 20.2 are embodied in such a way that the distance between two adjoining wave crests 20.1, or wave troughs 20.2, in the circumferential direction is matched to the corresponding contact surface of the motion transfer bodies; in the present case this distance is at least approximately equal to the radius of the spherical motion transfer bodies 24, so that the motion transfer bodies 24 can snuggle, so to speak, in the wave troughs 20.2. The radial difference between the wave crest 20.1 and the wave trough 20.2 is $\Delta r$. The fact that respectively one wave crest 20.1 and one wave trough 20.2 are located diametrically facing each other was taken into consideration in the selection of the number of wave crests 20.1 and wave troughs 20.2, however, this is not absolutely necessary, because the device is also able to function if the wave crests 20.1 and the wave troughs 20.2 are not located exactly opposite each other. The wave crests and the wave troughs need not be embodied symmetrically. In the present example the outside surface of the wave wheel 20 is touched by two of the four guide bodies 24 at a wave crest 20.1, and by the remaining two guide bodies 24 in a wave trough 20.2.

The wave wheel 20 has a first recess 20.3 with a shoulder 20.4 and a second recess 20.5, possibly containing a body, and having a shoulder 20.6. A spring washer 26, or a retaining element 26, rests on the shoulder 20.4 in the first recess 20.3 and is represented in greater detail in FIG. 6 and described further down below. A cylinder 28 is received above the spring washer 26 in the recess 20.3 of the wave wheel 20. A linear securing bolt 30, which constitutes a securing element of the device 10, is received in a central bore of the cylinder 28 in a linearly displaceable manner. In the position represented in FIGS. 1 and 2, the end of the linear securing bolt 30 projecting out of the top of the cylinder 28 engages a recess 16.1 of the cover plate 16, which is represented in FIG. 7. The end of the linear securing bolt 30 projecting at the bottom out of the cylinder 28 and extending through the spring washer 26 has a lesser diameter than the remainder of the linear securing bolt 30.

The spring washer 26 consists of a circular ring 26.1, from which four fingers 26.2, used as retaining members, project inward in the direction toward the center of the spring washer 26. The fingers 26.2 are arranged at 90° in respect to each other and have inner edges 26.3, which are located on a common circle, wherein the diameter of the circle corresponds to the diameter of the lower end of the linear securing bolt 30.

In accordance with FIG. 4, the base plate 14 moreover has a recess 14.8 extending perpendicularly in respect to the support device axis T, and therefore radially in the housing 13. A transverse securing bolt 32 is displaceably received in this recess 14.8 and is maintained on the cover plate 16 by a protrusion 16.2. The transverse securing bolt 32 constitutes a securing element of the device 10. The end area of the recess 14.8 adjoining the periphery of the housing 13 contains a spring 34, which exerts a spring force on the transverse securing bolt 32 and biases it in the direction toward the support device axis T. The end face of the transverse securing bolt 32 pointing away from the spring 34 here rests against the tumbling ring 22 by the effect of the spring force of the spring 34 and blocks the tumbling ring 22, as well—via the motion transfer bodies 24—as the operating body, i.e. the wave wheel 20.

The functioning of the device will be described in what follows:

In the position represented in FIGS. 1 to 7, the device 10 is in its mounted, or initial, or securing position and is not subjected to noticeable forces. When using the device 10 as a component of a firing device in a spin-stabilized projectile, this is equivalent to the fact that the projectile has not yet been fired. Acceleration, or rotations, prior to firing the projectile are here so small that displacements of the linear securing bolt 30 and the transverse securing bolt 32 are impossible. An acceleration of the device 10 linearly in the direction of the support device axis T, as well as rotatingly around the support device axis T, which correspond to firing the projectile, cause the following:

In the course of the linear acceleration of the device 10 in the direction of the support device axis T, the linear securing bolt 30 received in the cylinder 28, which constitutes the first securing element and in the position of rest is maintained in the cylinder 28 by the fingers 26.2 of the spring washer 26, does not immediately participate in the linear movement of the device 10, and therefore of the cylinder 28, in the direction of the support device axis T, or of the arrow A, because of its inertia. Because of this, the linear securing bolt 30 is displaced downward in relation to the cylinder 28; in the course of this the center portion of the linear securing bolt 30, whose diameter is larger than the diameter of the end portion, leaves the cylinder by deforming the four inwardly protruding fingers 26.2 of the spring washer 26. The deformed fingers 26.2 assume the approximate shape of a funnel, wherein the linear securing bolt 30 is stuck in the center of this funnel; the deformed fingers 26.2 of the spring washer 26 thus rest at an acute angle from the top to the bottom against the linear securing bolt 30 and in this way prevent the linear securing bolt 30 from taking up its initial relative position again. During the displacement of the linear securing bolt 30, its upper end which, up to now, had been fixed in place by the recess 16.1 in the cover plate 16, comes free. The securing effect of the linear securing bolt 30, which has prevented a rotation of the wave wheel 20, is therefore cancelled. However, the rotation of the wave wheel 20 continues to be prevented, namely by the transverse securing bolt 32, which rests by means of a spring force of the spring 34 against the tumbling ring 22 and in this way blocks the movement of the tumbling ring 22, of the motion transfer bodies 24 and the wave wheel 20.

During the rotational acceleration of the device 10 around the support device axis T, the transverse securing bolt 32 is not only subjected to the spring force, but also to a centrifugal force acting oppositely the spring force. If the rotational velocity is so high that this centrifugal force is greater than the spring force, the transverse securing bolt 32 is displaced in the recess 14.8 toward the periphery of the support device 12, the result of which is that the transverse securing bolt 32 no longer rests against the tumbling ring 22, so that the pressure of the tumbling ring 22 on the motion transfer bodies 24, and that of the latter on the wave wheel 20 is cancelled. Now the wave wheel 20, which constitutes the operating body of the device 10, is no longer blocked against a rotational movement.

As already mentioned, for one the wave wheel 20 is arranged eccentrically in respect to the support device axis T, and secondly contains an active mass, in the present case the cylinder 28, which is eccentrically arranged in respect to the eccentric trigger axis E. However, the active mass need not be combined with the cylinder 28. Starting with the rotation of the housing 13 around its own axis, i.e. around the support device axis T. a rotary acceleration acts on the wave wheel 20. The wave wheel 20 rotates together with the support device, or housing 13 as long as it is secured on the support device, or housing 13 by means of the linear securing bolt 30 and the transverse securing bolt 32. As soon as the wave wheel 20 is no longer blocked by the linear securing bolt 30 and the transverse securing bolt 32, i.e. is not secured on the support device, or housing 13, it rotates in relation to the support device, or housing 13, namely out of an initial position around the eccentric trigger axis E into its end position, or operating position, in which the mass center of gravity of the wave wheel 20, and therefore the actual mass, or the cylinder 28, are at the greatest possible distance from the support device axis T. In the present exemplary embodiment the initial position is offset by approximately 180° in respect to the final position; thus the wave wheel 20 performs a rotation over approximately 180° inside the support body, or housing 13. In the present exemplary embodiment the longitudinal axis of the cylinder 28, seen in FIG. 1, is located at L(α) prior to the rotation of the wave wheel 20 in relation to the housing 13, and on the connecting straight line of the projections of T and E after the rotation of the wave wheel 20 in relation to the housing 13. Arming, or readiness of the device 10 is achieved as soon as the wave wheel 20 has reached its end position, or operational position.

Even with a slightly altered configuration, during a rotation the wave wheel 20 will always have the tendency to arrive in a position in which its center of gravity is as far away as possible from the support device axis T; the end position of the wave wheel 20 is defined in this way. The displacement of the initial position of the wave wheel 20 in respect to the end position effects the time interval in which the movement of the wave wheel 20 takes place.

The time interval required by the wave wheel 20 for its rotation inside the housing 13 from its initial position into its end position therefore essentially determines the length of the arming process and in this way affects the so-called fuse-timing length when using the device 10 in projectiles. Without delaying steps the wave wheel 20 would rotate very quickly into its end position, so that the time interval mentioned would be very short, which is generally not desired. The functions of the device 10 described so far can also occur if a wheel with a cylindrical outer surface were provided in place of the wave wheel 20. The special, i.e. wavy, embodiment of the outer surface of the wave wheel 20 is used, together with the tumbling ring 22 and the motion transfer bodies 24, to perform a delaying effect and to increase the mentioned time interval. Here, the functioning is as follows:

After the device 10 has started its linear movement in the direction of the arrow A and its rotary movement around the support device axis T, the release of the wave wheel 20 takes place as described above because of the displacement of the linear securing bolt 30, as well as the release of the tumbling ring 22 on account of the displacement of the transverse securing bolt 32. Hereupon the wave wheel 20 starts its rotation around the eccentric trigger axis E. From this result relative movements between the wave wheel 20 on the one hand and the motion transfer bodies 24 on the other. The wave wheel 20 rotates inside the motion transfer bodies 24, so to speak, wherein the motion transfer bodies alternatingly touch the wave crests 20.1 and the wave troughs 20.2 and in this way are caused by the wave wheel 20 to make a back-and forth, or guided swinging radial movement, wherein the distance between the motion transfer bodies 24 and the eccentric axis E alternatingly increases and decreases by the distance $\Delta r$. As already mentioned, the wave crests 20.1 and the wave troughs 20.2 of the wave wheel are located diametrically facing each other. The tumbling ring 22, which touches the motion transfer bodies 24 from the outside, is inevitably put into a sort of tumbling movement by the movement of these motion transfer bodies 24, which explains the choice of its designation. In this way the tumbling ring 22 so to speak takes over the role played by the balance wheel of a clockwork. The time interval, which the wave wheel 20 requires for arriving from its initial position in its end position, is increased by the delays and accelerations resulting in the course of the movements of the motion transfer bodies 24 and the tumbling ring 22.

What is claimed is:

1. A securing and arming device, having an operating body, which, prior to an arming time, is secured in a position of rest on a support device by means of a securing element, which is in a securing position, can, for the purpose of arming, be released by the securing element which is moved into a release position in relation to the support device, and can, after the arming time, be brought into an operating position by a rotary movement around a trigger axis, and having a delay element, which is designed to be driven in the course of the rotational movement of the operating body and to delay the rotational movement of the operating body, characterized in that the operating body and the delay element are arranged one inside the other, so that the operating body and the delay element constitute an outer wheel without a wheel shaft and an inner wheel without a wheel shaft, which wheels have parallel geometric wheel axes and define a ring-like gap therebetween, wherein at least one of the wheels is embodied to be wavy on a surface facing the other one of the wheels, with wave crests and wave troughs over a circumference, and with areas of the surfaces facing each other, the wheels rest against motion transfer bodies located in the ring-like gap, which are seated radially displaceable in the gap.

2. The securing and arming device in accordance with claim 1, characterized in that the inner wheel is constituted by the operating body.

3. The securing and arming device in accordance with claim 1, characterized in that the operating body has the wave troughs and the wave crests on the surface of the operating body.

4. The securing and arming device in accordance with claim 1, characterized in that the operating body has an eccentrically arranged inertial mass and is arranged on a support device having a support device axis, in relation to which the trigger axis is arranged eccentric and parallel, wherein the inertial mass in the position of rest of the operating body preferably has the shortest possible distance from the support device axis, and is fastened on the support device by means of the securing element, which is in the securing position, and has the greatest possible distance from the support body axis in the operating position of the operating body.

5. The securing and arming device in accordance with claim 1, characterized in that the securing element is displaced out of the securing position into the release position by means of a rotary movement of the support device.

6. The securing and arming device in accordance with claim 1, characterized in that the securing element is a transverse securing bolt, which is arranged in a plane extending transversely in relation to the trigger axis, with the support device at rest, takes up the securing position, wherein the support device is biased toward the operating body, which is in the position of rest, by the force of a spring, and with the support device rotating, reaches the release position by the effect of the centrifugal force acting opposite to the force of the spring, in the course of which securing element releases the operating body for performing a rotary movement relative to the support device around the trigger axis.

7. The securing and arming device in accordance with claim 1, characterized in that a further securing element is provided, which with the support device not accelerated linearly, takes up a securing position, wherein the securing element secures the operating body on the support device, and with the support device accelerated linearly in the direction of the support device axis, reaches the release position, wherein the securing element releases the operating body to make a rotary movement in relation to the support device around the trigger axis.

8. The securing and arming device in accordance with claim 7, characterized in that the further securing element is a linear securing bolt, which is received in a recess of the operating body, past which the securing element projects with a first end and a second end, wherein, with the support device not accelerated linearly, the first end is maintained on the support device, and the second end is prevented from being displaced by means of a retaining force of a retaining element, and with the support device accelerated linearly, the retaining element is deformed by means of the inertial force of the linear securing bolt directed opposite to the retaining force, such that the linear securing bolt is released to make a linear movement in relation to the support element.

9. The securing and arming device in accordance with claim 8, characterized in that the retaining element has resilient retaining members which when the support device is not linearly accelerated keep the linear securing bolt in the securing position, when the support device is linearly accelerated, the resilient retaining members are deformed by the force of the linear security bolt in order to permit the displacement of the linear security bolt out of the securing position into the release position, in order to maintain the linear securing bolt in the securing position after the linear securing bolt has been displaced.

10. The securing and arming device in accordance with claim 8, characterized in that the total dimension of the securing and arming device in the direction of the support device axis remains constant at best during the displacement of the linear securing bolt.

11. The securing and arming device in accordance with claim 9, characterized in that the retaining members define a circle having a diameter equal to the diameter of the one end of the linear securing bolt, which end has a lesser diameter than the remainder of the linear securing bolt and projects out of the operating body through the circle.

12. The securing and arming device in accordance with claim 8, characterized in that the linear securing bolt is received in a hollow cylinder, which is arranged in the recess of the operating body and constitutes the inertial mass of the operating body.

13. The securing and arming device in accordance with claim 1, characterized in that the motion transfer bodies are arranged concentrically in respect to the operating body on the support device, wherein the motion transfer bodies are secured against movement in relation to the support device in the direction of the support body axis and in the direction of the circumference of the operating body.

14. The securing and arming device in accordance with claim 1, characterized in that the motion transfer bodies are rotational solids, preferably spheres.

15. The securing and arming device in accordance with claim 1, characterized in that the support device is embodied as a housing having a base plate and a cover plate.

16. Use of the securing and arming device in accordance with claim 1 as a securing and arming device of a spin-stabilized projectile, characterized in that the support device is fixedly connected with a rotating part of the projectile, wherein the support device axis coincides at least approximately with the longitudinal axis of the projectile.

17. A spin-stabilized projectile comprising:

a casing defining a rotating part of the projectile and the longitudinal axis of the projectile about which the projectile is spin-stabilized; and a securing and arming device having an operating body, which, prior to an arming time, is secured in a position of rest on a support device by means of a securing element, which is in a securing position, can, for the purpose of arming, be released by the securing element which is moved into a release position in relation to the support device, and can, after the arming time, be brought into an operating position by a rotary movement around a trigger axis, and having a delay element, which is designed to be driven in the course of the rotational movement of the operating body and to delay the rotational movement of the operating body, characterized in that the operating body and the delay element are arranged one inside the other, so that the operating body and the delay element constitute an outer wheel without a wheel shaft and an inner wheel without a wheel shaft, which wheels have parallel geometric wheel axes and define a ring-like gap therebetween, wherein at least one of the wheels is embodied to be wavy on a surface facing the other one of the wheels, with wave crests and wave troughs over a circumference, and with areas of the surfaces facing each other, the wheels rest against motion transfer bodies located in the ring-like gap, which are seated radially displaceable in the gap, and the support device is fixedly connected with the rotating part of the projectile with the trigger axis arranged generally parallel with the longitudinal axis of the projectile.

18. A spin stabilized projectile as in claim 17 wherein the supporting device has a central axis and the supporting device is connected to the casing with the central axis approximately coincident with the longitudinal axis.

* * * * *